US010479091B2

(12) United States Patent
Mashima et al.

(10) Patent No.: US 10,479,091 B2
(45) Date of Patent: Nov. 19, 2019

(54) LIQUID DISCHARGE APPARATUS AND WASTE LIQUID AMOUNT DETECTION METHOD

(71) Applicant: SEIKO EPSON CORPORATION, Tokyo (JP)

(72) Inventors: Akira Mashima, Azumino (JP); Seijun Horie, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/915,692

(22) Filed: Mar. 8, 2018

(65) Prior Publication Data

US 2018/0272720 A1 Sep. 27, 2018

(30) Foreign Application Priority Data

Mar. 23, 2017 (JP) ..... 2017-057929

(51) Int. Cl.
*B41J 2/17* (2006.01)
*B41J 2/185* (2006.01)
*B41J 2/175* (2006.01)

(52) U.S. Cl.
CPC ..... *B41J 2/1721* (2013.01); *B41J 2/17566* (2013.01); *B41J 2/185* (2013.01); *B41J 2002/17569* (2013.01); *B41J 2002/17589* (2013.01); *B41J 2002/1853* (2013.01); *B41J 2002/1856* (2013.01)

(58) Field of Classification Search
CPC ..... B41J 2/1721; B41J 2/185; B41J 2/17566; B41J 2002/1856; B41J 2002/1853; B41J 2002/17589; B41J 2002/17569
See application file for complete search history.

(56) References Cited

U.S. PATENT DOCUMENTS

2004/0075712 A1* 4/2004 Ono ..... B41J 2/1721 347/36
2005/0018000 A1 1/2005 Ishihara
2005/0146585 A1* 7/2005 Akase ..... B41J 2/185 347/89

FOREIGN PATENT DOCUMENTS

JP 2007237577 9/2007
JP 2011-025599 A 2/2011
JP 2011046062 3/2011

OTHER PUBLICATIONS

European Search Report issued in Application No. 18162503 dated Jul. 17, 2018.

* cited by examiner

*Primary Examiner* — Geoffrey S Mruk
(74) *Attorney, Agent, or Firm* — Workman Nydegger

(57) ABSTRACT

A liquid discharge apparatus includes a liquid discharge section configured to discharge liquid onto a medium, a holding section capable of holding a waste liquid container capable of containing waste liquid exhausted from the liquid discharge section, a sensor capable of detecting a state in which a containing amount of the waste liquid container has reached a threshold value, and a calculation section configured to calculate a waste liquid amount based on an exhaust amount of the waste liquid exhausted by the liquid discharge section. In the case where the sensor has detected the state in which the containing amount has reached the threshold value, the calculation section calculates the waste liquid amount by adding the exhaust amount of the waste liquid exhausted after the detection of the state by the sensor to the threshold value.

4 Claims, 3 Drawing Sheets

LIQUID DISCHARGE APPARATUS AND WASTE LIQUID AMOUNT DETECTION METHOD

BACKGROUND

1. Technical Field

The present invention relates to a liquid discharge apparatus, such as a printer, and a waste liquid amount detection method.

2. Related Art

As an example of a liquid discharge apparatus, there exists an ink jet recording apparatus provided with both of a means for calculating a waste liquid amount by summing, in a software manner, the amount of waste ink resulting from maintenance operation, and a means for detecting, in a hardware manner, the amount of accumulated waste ink (for example, JP-A-2011-25599).

In the case where the waste liquid amount is obtained by performing summation in a software manner, because of evaporation of waste ink, and the like, error occurs between the waste liquid amount resulting from the summation in the software manner and the amount of actually accumulated waste ink. On the other hand, for the detection means in the hardware manner, it is difficult to minutely manage the accumulated amount.

SUMMARY

An advantage of some aspects of the invention is that a liquid discharge apparatus and a waste liquid amount detection method are provided that enable the achievement of suitable management of waste liquid.

A liquid discharge apparatus according to an aspect of the invention includes a liquid discharge section configured to discharge liquid onto a medium, a holding section capable of holding a waste liquid container configured to contain waste liquid exhausted from the liquid discharge section, a sensor capable of detecting a state in which a containing amount of the waste liquid container has reached a threshold value, and a calculation section configured to calculate a waste liquid amount based on an exhaust amount of the waste liquid exhausted by the liquid discharge section, and in the case where the sensor has detected the state in which the containing amount has reached the threshold value, the calculation section calculates the waste liquid amount by adding the exhaust amount of the waste liquid exhausted after the detection of the state by the sensor to the threshold value.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a liquid discharge apparatus and a waste liquid detection method will be described with reference to the drawings. The liquid discharge apparatus is, for example, an ink jet printer that performs printing on a medium, such as paper, by discharging inks as an example of liquids.

Figure 1:
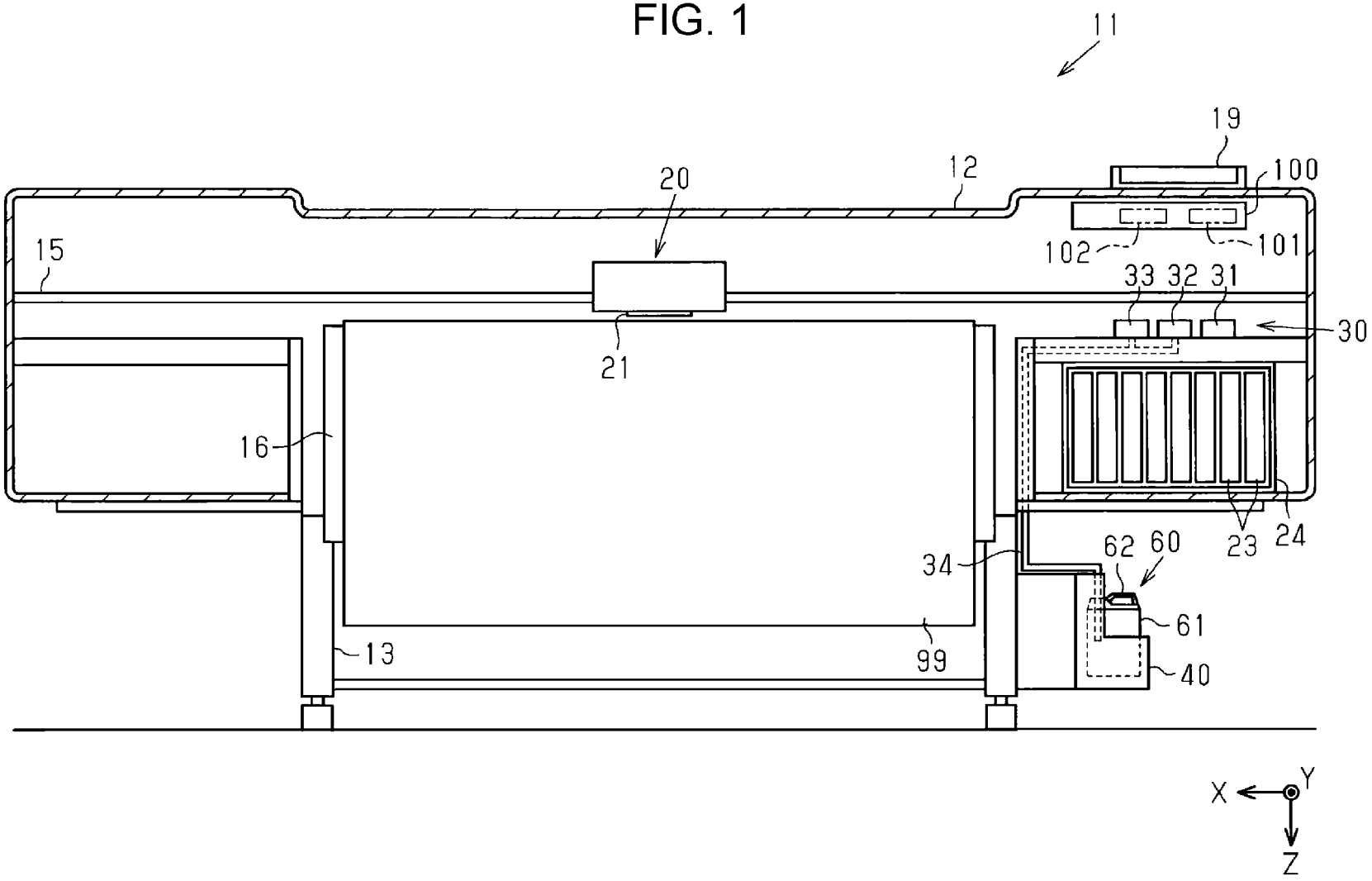
FIG. 1 is an overall configuration diagram of one embodiment of a liquid discharge apparatus.

As illustrated in FIG. 1, the liquid discharge apparatus 11 includes a housing 12, a leg section 13, a liquid discharge section 20, a maintenance mechanism 30, a holding mechanism 40, and an mounting section 24. The leg section supports the housing 12. The mounting section 24 is capable of mounting liquid containers 23. The liquid discharge section 20, the maintenance mechanism 30, and the mounting section 24 are preferable to be contained inside the housing 12. The holding mechanism 40 is preferable to be disposed at a position outside the housing 12 so as to be easily viewed by a user. The holding mechanism 40 is preferable to be secured to, for example, the leg section 13. An operation panel 19 is preferable to be provided on the housing 12. Through this operation panel 19, instructions for operation can be input and operation statuses can be displayed.

The liquid discharge section 20 includes a discharge head 21, and this discharge head 21 is capable of discharging liquids. Each of the liquid containers 23 is a tank capable of accumulating a corresponding one of liquids supplied to the liquid discharge section 20. Each of the liquid containers 23 may be a cartridge as an exchangeable reservoir.

The liquid discharge section 20 is configured to discharge the liquids onto a medium 99 while reciprocating in both a direction X and a direction opposite to the direction X. The medium 99 having been subjected to the printing by the discharge of the liquids is transported in a direction Y; exits outside the housing 12; and hangs down in a gravity direction Z. The direction X, the direction Y, and further the gravity direction Z are directional axes forming three axes.

The liquid discharge apparatus 11 includes, inside the housing 12, a guide shaft 15, a medium support section 16, and a control device 100. The guide shaft 15 guides the movement of the liquid discharge section 20. The medium support section 16 is capable of supporting the medium 99. The control device 100 controls constituent elements of the liquid discharge apparatus 11, such as the discharge head 21 and the like. The medium support section 16 is capable of supporting the medium 99 that is ejected to the outside of the housing 12 in a way that allows the front edge of the medium 99 to protrude to the outside of the housing 12.

The maintenance mechanism 30 includes a suction mechanism 32 and a waste liquid tube 34. The suction mechanism 32 eliminates foreign materials, such as air bubbles, existing inside the liquid discharge section 20 by performing suction of the discharge head 21. Such a maintenance operation for causing liquid to be flown out as waste liquid from the discharge head 21 is called cleaning. In the cleaning, the waste liquid may be exhausted from the discharge head 21 by applying pressure to the inside of the liquid discharge section 20.

The waste liquid having been exhausted by the cleaning is contained in a waste liquid container 60 through the waste liquid tube 34. The waste liquid container 60 is a container capable of containing the waste liquid exhausted from the liquid discharge section 20. The waste liquid container 60 includes a body 61 and a gripper 62. The body 61 contains the waste liquid. The gripper 62 is attached to the body 61.

The maintenance mechanism 30 may include a sweep member 31 or a waste liquid receiving section 33. The sweep member 31 sweeps away foreign materials, such as liquid adhered to the discharge head 21, while relatively moving relative to the discharge head 21. When the liquid discharge section 20 discharges the liquids as waste liquid, the waste liquid receiving section 33 receives the discharged waste liquid. Such a maintenance operation by the liquid discharge section 20 for exhausting the waste liquid by means of the discharge is called flushing. The waste liquid having been received by the waste liquid receiving section 33 may be contained in the waste liquid container 60 through the waste liquid tube 34.

The control device 100 includes a calculation section 101 and a storage section 102. The calculation section 101 is capable of calculating the waste liquid amount. The storage section 102 stores therein data, such as the waste liquid amount. The calculation section 101 calculates the waste liquid amount on the basis of the exhaust amount of the waste liquid that is exhausted from the liquid discharge section 20 along with maintenance operation, such as the cleaning. The storage section 102 also stores therein a program for calculating the waste liquid amount.

Figure 2:
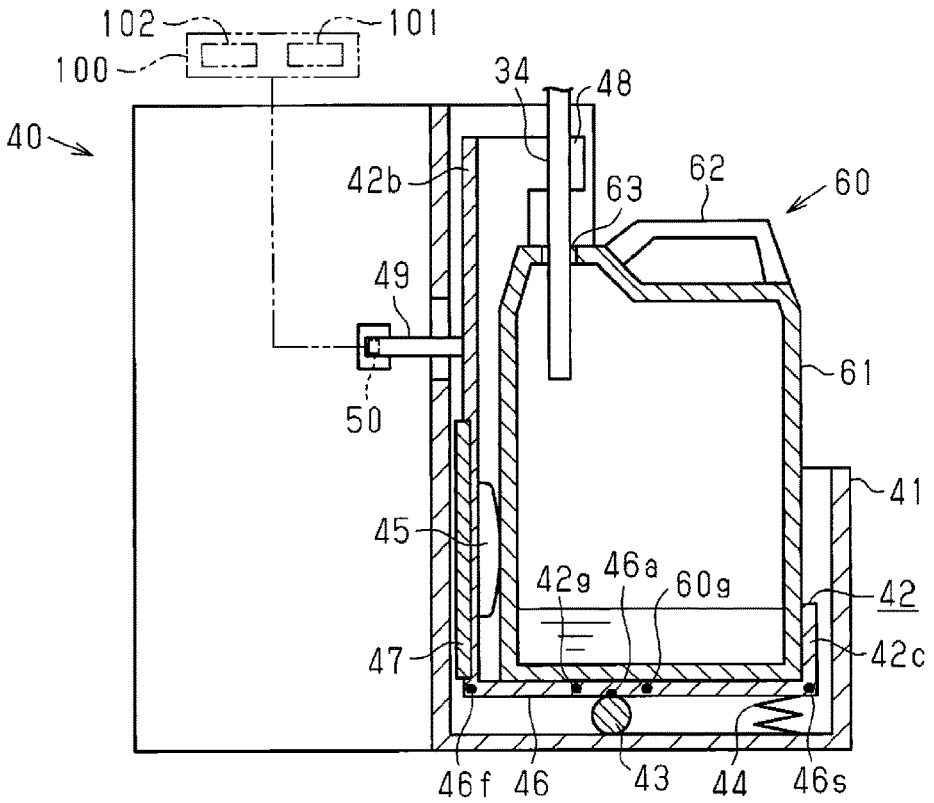
FIG. 2 is a cross-sectional view of a holding mechanism and a waste liquid container included in the liquid discharge apparatus illustrated in FIG. 1.
Figure 3:
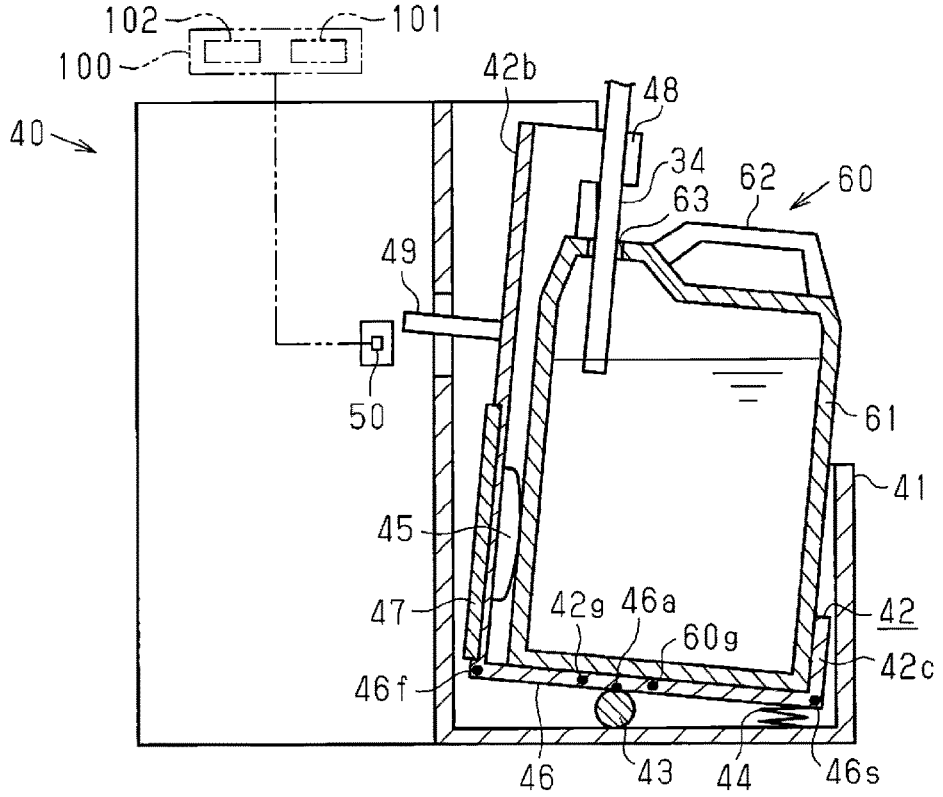
FIG. 3 is a diagram illustrating the behavior of the holding mechanism illustrated in FIG. 2.

As illustrated in FIGS. 2 and 3, the waste liquid container 60 includes an opening 63. The waste liquid tube 34 is insertable through this opening 63. The liquid having been accumulated in the liquid waste liquid container 60 can be disposed of through the opening 63. Thus, the waste liquid container 60 is repeatedly usable.

The holding mechanism 40 includes a container case 41, a holding section 42, a supporting point member 43, and a sensor 50. The holding section 42 is capable of holding the waste liquid container 60 inside the container case 41. The supporting point member 43 supports the holding member 42. The sensor 50 is preferable to be, for example, an optical sensor or a mechanical sensor. The sensor 50 is electrically connected to the control device 100. At least part of the waste liquid container 60 held by the holding section 42 is exposed to the outside of the container case 41.

The holding section 42 includes a bottom wall 46, a rear wall 42*b*, and a front wall 42*c*. The bottom wall 46 is in contact with the supporting point member 43. The rear wall 42*b* extends from a base edge 46*f* of the bottom wall 46, and the front wall 42*c* extends from a front edge 46*s* of the bottom wall 46. The holding section 42 may include a guide section 48 and a detection section 49. The guide section 48 guides the waste liquid tube 34 toward the opening 63. The detection section 49 extends toward the sensor 50.

The supporting point member 43 is disposed under the bottom wall 46 to support the holding section 42 at a supporting point 46*a*. This supporting point 46*a* is located between the base edge 46*f* and the front edge 46*s*. The holding section 42 is configured to be capable of tilting about the supporting point 46*a*, which serves as a supporting point of the tilting, between a first posture illustrated in FIG. 2 and a second posture illustrated in FIG. 3. The detection section 49 is displaced along with the tilting of the holding section 42. In the case where, when the holding section 42 is in the first posture, a position at which a vertical line passing through the gravity point of the holding section 42 intersects with the bottom wall 46 is referred to as a gravity position 42*g*, the gravity position 42*g* is located closer to the base edge 46*f* than the supporting point 46*a*.

When the holding section 42 holding the waste liquid container 60 is in the first posture, a position at which a vertical line passing through the gravity point of the waste liquid container 60 intersects with the bottom wall 46 is referred to as a gravity position 60*g*. In this case, the gravity position 60*g* is located closer to the front edge 46*s* than the supporting point 46*a*.

The holding section 42 is preferable to include a positioning spring 45. This positioning spring 45 has the function of pressing the waste liquid container 60 mounted on the bottom wall 46 toward the front wall 42*c*. This method of pressing the waste liquid container 60 toward the front wall 42*c* using the positioning spring 45 reduces the variation of the gravity position 60*g* of the waste liquid container 60 being held by the holding section 42.

The holding section 42 takes the first posture in a state of not holding the waste liquid container 60 as well as in a state of holding the waste liquid container 60 whose content is empty. When the waste liquid has been introduced into the waste liquid container 60 held by the holding section 42 through the waste liquid tube 34, the waste liquid container 60 becomes heavy. When the containing amount of the waste liquid container 60 exceeds a threshold value V1 along with the introduction of the waste liquid, the waste liquid container 60 is tilted together with the holding section 42.

In this way, the holding section 42 is configured to take the first posture when the containing amount of the waste liquid container 60 is smaller than the threshold value V1, and to be tilted into the second posture from the first posture when the containing amount has become larger than or equal to the threshold value V1. The threshold value V1 at the time when the holding section 42 is tilted can be set to, for example, a proportion falling within a range from 50% to 80% of the containing amount of the waste liquid container 60. In the present embodiment, 70% of the containing amount is exemplified as the threshold value V1. The storage section 102 stores therein the threshold value V1 and a full capacity V2. This full capacity V2 is a capacity when the waste liquid container 60 is in a full state. The full capacity V2 may be set to a proportion falling within a range from 90% to 100% of the containing amount of the waste liquid container 60.

In order to set the threshold value V1 to a large value, the holding section 42 may include a weight 47 on the rear wall 42*b*. Alternatively, in order to set the threshold value V1 to a large value, the holding mechanism 40 may include an energization member 44. This energization member 44 supports the bottom wall 46 at a position closer to the front edge 46*s* than the gravity position 42*g*.

The sensor 50 is configured to detect the displacement of the holding section 42, which is caused by the tilting of the holding section 42. For example, when the holding section 42 is in the first posture, the sensor 50 detects the detection section 49, and when the holding section 42 is in the second posture, the sensor 50 does not detect the detection section 49. The sensor 50 repeats the detection at constant intervals. The sensor 50 transmits an ON signal to the control device 100 when having detected the detection section 49, and transmits an OFF signal to the control device 100 when having not detected the detection section 49.

The holding section 42 is tilted into the second posture when the containing amount of the waste storage section 60 has increased and has become large. Thus, the sensor 50 is configured to, based on the weight of the waste liquid container 60, detect a state in which the containing amount of the waste liquid container 60 has reached the threshold value V1.

Next, an embodiment of a waste liquid amount detection method for detecting waste liquid exhausted from the liquid discharge section 20 and contained in the waste liquid container 60 will be described.

Figure 4:
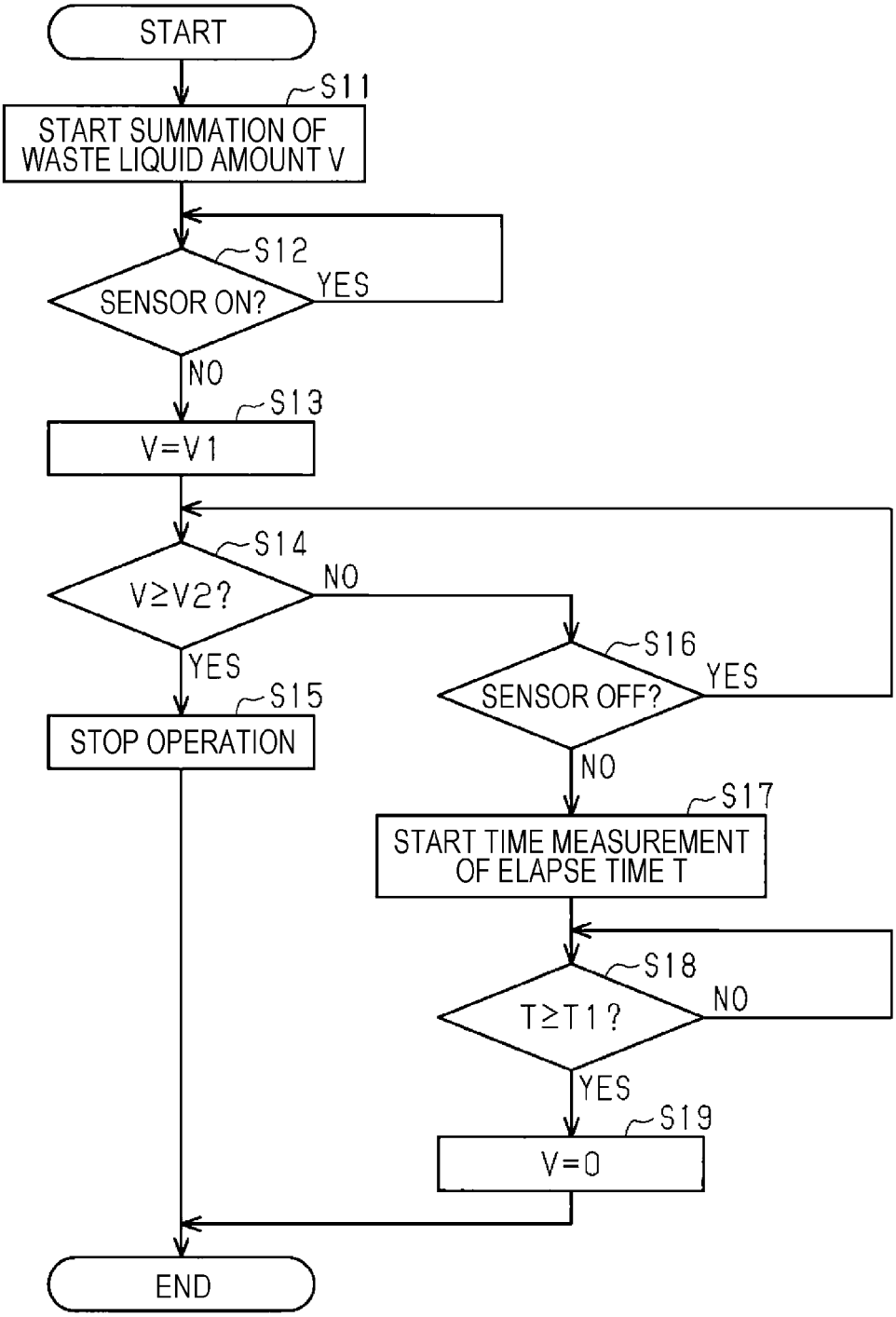
FIG. 4 is a flowchart illustrating processing according to one embodiment of a waste liquid amount detection method.

Upon start of operation by the liquid discharge section 20, the control device 100 executes processes illustrated in FIG. 4.

First, as step S11, the calculation section 101 starts and sequentially executes summation processing for calculating an exhaust amount of the waste liquid exhausted by the liquid discharge section 20, summing the calculated exhaust amount, and allowing the storage section 102 to store therein a summation value resulting from the summation as a waste liquid amount V.

In step S12 subsequent to step S11, the control device 100 receives a signal transmitted from the sensor 50, and determines whether the signal from the sensor 50 is the ON signal or the OFF signal. In the case where the signal is the OFF signal, the sensor 50 has detected the state in which the containing amount of the waste liquid having been contained in the waste liquid container 60 has reached the threshold value V1 (the detection process). In this case, the control device 100 allows the process flow to proceed to step S13. In the case where the signal is the ON signal, the containing amount of the waste liquid having been contained in the waste liquid container 60 does not reach the threshold value V1. In this case, the control device 100 repeats the process of steps S12.

In step S13, the control device 100 rewrites the waste liquid amount V stored by the storage section 102 into the threshold value V1. That is, when the sensor 50 has detected the state in which the containing amount of the waste liquid has reached the threshold value V1, the calculation section 101 employs the threshold value V1 having been detected in the mechanical manner as the waste liquid amount V, instead of the summation value having been calculated in the software manner. After having replaced the waste liquid amount V with the threshold value V1, the calculation section 101 calculates the waste liquid amount V by sequentially executing summation processing for calculating an exhaust amount of waste liquid that is exhausted thereafter, and adding a value of the calculated exhaust amount to the threshold value V1 (the calculation process).

In step S14 subsequent to step S13, the control device 100 determines whether or not the liquid waste amount V resulting from the summation has become larger than or equal to the full capacity V2. In the case where the liquid waste amount V is larger than or equal to the full capacity V2, the control device 100 allows the process flow to proceed to step S15; while, in the case where the liquid waste amount V is smaller than the full capacity V2, the control device 100 allows the process flow to proceed to step S16.

In step S15, the control device 100 stops the operation of the liquid discharge section 20 and the operation of the suction mechanism 32 (that is, at least operation in conjunction with the exhaust of the waste liquid), and terminates the process flow.

In the case where, in step S15, the operation of the liquid discharge section 20 has been stopped, the control device 100 is preferable to display, on the operation panel 19, a message for prompting a user to dispose of the waste liquid having been accumulated in the waste liquid container 60. In the case where the user has input, through the operation panel 19, a confirmation that the user has disposed of the waste liquid, the control device 100 is preferable to resume the operation of the liquid discharge section 20 and the operation of the suction mechanism 32.

In step S16, the control device 100 receives the signal transmitted from the sensor 50, and determines whether the signal from the sensor 50 is the ON signal or the OFF signal. In the case where the signal is the ON signal, the control device 100 allows the process flow to proceed to S17; while, in the case where the signal is the OFF signal, the control device 100 allows the process flow to return to step S14.

In step S17, the control device 100 starts a time measurement of an elapse time T from a time when the sensor 50 has entered an ON state.

In step S18 subsequent to step S17, the control device 100 determines whether or not the elapse time T has become larger than or equal to a confirmation time T1. The confirmation time T1 is a time that is assumed to be at least necessary for the user to detach the waste liquid container 60 from the holding section 42, dispose of the accumulated waste liquid, and return the waste liquid container 60 having become empty to the holding section 42. The confirmation time T1 is, for example, a time falling within a range from 10 seconds to 20 seconds.

In step S18, in the case where the elapse time T is larger than or equal to the confirmation time T1, the control device 100 allows the process flow to proceed to step S19; while, in the case where the elapse time T is smaller than the confirmation time T1, the control device 100 repeats the process of step S18.

In step S19, the calculation section 101 rewrites the waste liquid amount V resulting from the summation into zero, and terminates the process flow. In this way, when the holding section 42 has returned to the first posture from the second posture, the calculation section 101 resets the waste liquid amount V.

Next, the behavior of the liquid discharge apparatus 11 and the waste liquid amount detection method will be described.

The calculation section 101 is also capable of calculating the waste liquid amount V in a software manner, and displaying a message for prompting a user to dispose of the waste liquid of the waste liquid container 60 on the operation panel 19 or the like in the case where the summation value of the waste liquid amount V has become larger than or equal to the full capacity V2. In this case, when the containing amount is decreased due to evaporation or is increased due to dew condensation, there occurs error between an actual containing amount and a summation value calculated by the calculation section 101. In the case where the containing amount of the waste liquid container 60 exceeds the full capacity V2 due to such error, the waste liquid overflows and stains the holding mechanism 40.

In contrast, in the case where the sensor 50 detects that the containing amount has become the full capacity V2, accuracy may be lower than the case where the calculation section 101 performs calculation in a software manner. Further, in the case where the operation of the liquid discharge section 20 and the like is caused to stop when the sensor 50 has detected that the containing amount has become the full capacity V2, the printing is stopped in mid-flow and, as a result, the medium 99 may be wasted.

In the present embodiment, the sensor 50 detects, in the mechanical manner, the state in which the containing amount of the waste liquid container 60 has reached the threshold value V1, and thereafter, the calculation section 101 calculates the waste liquid amount V in the software manner during a period when the containing amount of the waste liquid container 60 is increased from the threshold value V1 up to the full capacity V2. Thus, a user is able to manage the waste liquid contained in the waste liquid container 60 in a suitable manner.

When the sensor 50 has detected the state in which the containing amount of the waste liquid has reached the threshold value V1, the control device 100 may report this situation to the user via the operation panel 19 or the like. The content of the reporting at this time may be, for example, an instruction for instructing a user to dispose of the content of the waste liquid container 60, or a notification for notifying a remaining capacity of the waste liquid container 60.

When the containing amount of the waste liquid container 60 has reached the threshold value V1, the waste liquid container 60 is tilted together with the holding section 42. Thus, when having viewed the tilting of the waste liquid container 60, a user is able to know that the waste liquid container 60 will be in a full state in a short time. Even though the waste liquid container 60 is a transparent tank, when liquid having a deep color is adhered to its inner face, it becomes difficult to see the liquid face inside it. In this regard, the tilting of the waste liquid container 60 enables a user to view that the remaining amount of the waste liquid container 60 has become small even from a place separated from the operation panel 19.

When a user detaches the waste liquid container 60 from the holding section 42 at the stage when the containing amount has reached the threshold value V1, the state of the sensor 50 returns to the ON state from the OFF state. Even when the waste liquid container 60 whose content has been made empty is returned to the holding section 42 thereafter, the sensor 50 remains in the ON state. In this way, upon elapse of the confirmation time T1 from the return of the sensor 50 to the ON state, the waste liquid amount V is reset.

Even though the user views the tilting of the waste liquid container 60 and detaches the waste liquid container 60 from the holding section 42, the user may return it to the holding section 42 in a state in which the waste liquid inside the waste liquid container 60 is not disposed of. At this time, in the case where the calculation section 101 resets the waste liquid amount V to zero, waste liquid is introduced into the waste liquid container 60 being in a full state, and as a result, the waste liquid may overflow. In this regard, the possibility of that the operation of disposing of the waste liquid has been completed during the confirmation time T1 is high, provided that a time point when the waste liquid amount V is to be reset is after the elapse time T has become larger than or equal to the confirmation time T1. For this reason, the possibility of that the waste liquid overflows is reduced by providing steps S17 and S18. In the case where such the conformation time T1 is unnecessary, steps S17 and S18 may be omitted.

According to the aforementioned embodiment, the following advantageous effects are brought about.

(1) The sensor 50 detects a state in which the containing amount of the waste liquid container 60 has reached the threshold value V1, and thereafter, the calculation section 101 calculate an exhaust amount of waste liquid and adds the calculated exhaust amount to the threshold value V1, thus enabling a remaining-reduced remaining capacity of the waste liquid container 60 to be managed with accuracy.

(2) The detection by the sensor 50 enables the containing amount of the waste liquid container 60 to be managed with accuracy on the basis of the weight of the waste liquid container 60.

(3) The tilting of the housing 42 enables a user to view the state in which the containing amount of the waste liquid container 60 has reached the threshold value V1.

(4) When a user has performed operation for detaching the waste liquid container 60 from the holding section 42, disposing of the waste liquid, and returning the waste liquid container 60 whose weight has become small to the holding section 42, the holding section 42 returns to the first posture from the second posture. For this reason, in the case where the holding section 42 has returned to the first posture from the second posture, it is recognized that the containing amount of the waste liquid container 60 has become empty, thus enabling the waste liquid amount V resulting from the summation to be reset.

The aforementioned embodiment may be modified as shown in modification examples described below. One or more components included in the aforementioned embodiment can be optionally combined with one or more components included in modification examples described below, and components included in modification examples described below can be optionally combined with one another.

After the sensor 50 has detected a state in which the containing amount of the waste liquid container 60 has reached the threshold value V1, the calculation section 101 may start the summation of the exhaust amount. In this case, the calculation section 101 is preferable to sequentially add the exhaust amount to the threshold value V1 in a process flow in which step S11 is moved to a position immediately after step S13.

The holding mechanism 40 may include a plurality of holding sections 42. Particularly, in the case where the liquid discharge section 20 is configured to discharge a plurality of different kinds of liquids, waste liquids of the different kinds of liquids are preferable to be contained in separate waste liquid containers 60. For example, when the liquid discharge section 20 discharges a resin ink and a pre-treatment liquid for hardening the resin ink, there may occur a case where, in the case where the resin ink and the pre-treatment ink are mixed inside the waste liquid tube 34, the waste liquid is hardened and, as a result, the waste liquid tube 34 is clogged. For this reason, the different kinds of waste liquids are preferable to be separately collected.

The liquids ejected by the liquid discharge section 20 are not limited to the inks, and may be, for example, liquid substances each obtained by dispersing or mixing particles of a functional material into a liquid. For example, the liquid discharge section 20 may be configured to eject liquid substances in which materials, such as electrode materials, coloring materials (pixel materials), and the like that are used in the manufacturing of a liquid crystal display, an electroluminescence (EL) display, a plane emission display, and the like, are dispersed or dissolved.

The medium 99 is not limited to the paper, and may be plastic film, a thin plate material, or fabric used in a printing apparatus or the like. Further, the medium 99 may be optionally shaped clothing or the like, such as T shirt, or may be an optionally shaped tridimensional object, such as an eating utensil or a writing tool.

Hereinafter, technical thoughts grasped from the aforementioned embodiment and modification examples and advantageous behavior effects thereof will be described.

Technical Thought 1

A liquid discharge apparatus includes a liquid discharge section configured to discharge liquid onto a medium, a holding section capable of holding a waste liquid container configured to contain waste liquid exhausted from the liquid discharge section, a sensor capable of detecting a state in which a containing amount of the waste liquid container has reached a threshold value, and a calculation section configured to calculate a waste liquid amount based on an exhaust amount of the waste liquid exhausted by the liquid discharge section, and in the case where the sensor has detected the state in which the containing amount has reached the threshold value, the calculation section calculates the waste liquid amount by adding the exhaust amount of the waste liquid exhausted after the detection of the state by the sensor to the threshold value.

According to this configuration, the sensor detects the state in which the containing amount of the waste liquid container has reached the threshold value, and after the detection of the state by the sensor, the calculation section adds the exhaust amount of the waste liquid to the threshold value, thus enabling a remaining-reduced remaining capacity of the waste liquid container to be managed with accuracy. Accordingly, the waste liquid can be managed in a suitable manner.

Technical Thought 2

In the liquid discharge apparatus according to technical thought 1, the sensor is configured to, based on the weight of the waste liquid container, detect the state in which the containing amount has reached the threshold value.

According to this configuration, the detection by the sensor enables the containing amount of the waste liquid container to be managed with accuracy on the basis of the weight of the waste liquid container.

Technical Thought 3

In the liquid discharge apparatus according to technical thought 1 or technical thought 2, the holding section is configured to take a first posture when the containing amount is smaller than the threshold value, and to be tilted into a second posture from the first posture when the containing amount has become larger than or equal to the threshold value, and the sensor is configured to detect a displacement of the holding section as a result of the tilting of the holding section.

According to this configuration, the tilting of the holding section enables a user to view the state in which the containing amount has reached the threshold value.

Technical Thought 4

In the liquid discharge apparatus according to technical thought 3, the calculation section resets the waste liquid amount when the holding section has returned to the first posture from the second posture.

According to this configuration, when a user has performed operation for detaching the waste liquid container from the holding section, disposing of the waste liquid, and returning the waste liquid container whose weight has become small to the holding section, the holding section returns to the first posture from the second posture. Thus, in the case where the holding section has returned to the first posture from the second posture, it is recognized that the containing amount of the waste liquid container has become empty, thus enabling the waste liquid amount resulting from the summation to be reset.

Technical Thought 5

A waste liquid amount detection method for detecting a waste liquid amount of waste liquid exhausted from a liquid discharge section and contained in a waste liquid container includes a detection process of detecting a state in which a containing amount of the waste liquid having been contained in the waste liquid container has reached a threshold value, and a calculation process of, after the detection process, calculating the waste liquid amount by adding an exhaust amount of the waste liquid exhausted by the liquid discharge section to the threshold value.

According to this configuration, the state in which the containing amount of the waste liquid container has reached the threshold value is detected on the basis of the waste liquid having been actually contained, and after the detection of the state, the exhaust amount of the waste liquid is added to the threshold value, thus enabling a remaining-reduced remaining amount of the waste liquid container to be managed with accuracy. Accordingly, the waste liquid can be managed in a suitable manner.

This application claims priority under 35 U.S.C. § 119 to Japanese Patent Application No. 2017-057929, filed Mar. 23, 2017. The entire disclosure of Japanese Patent Application No. 2017-057929 is hereby incorporated herein by reference.

What is claimed is:

1. A liquid discharge apparatus comprising:

a liquid discharge section configured to discharge liquid onto a medium;

a holding section capable of holding a waste liquid container configured to contain waste liquid exhausted from the liquid discharge section;

a sensor capable of detecting a state in which a containing amount of the waste liquid container has reached a threshold value; and a calculation section configured to calculate a waste liquid amount based on an exhaust amount of the waste liquid exhausted by the liquid discharge section, wherein, in a case where the sensor has detected the state in which the containing amount has reached the threshold value, the calculation section calculates the waste liquid amount by adding the exhaust amount of the waste liquid exhausted after the detection of the state by the sensor to the threshold value.

2. The liquid discharge apparatus according to claim 1, wherein the sensor is configured to, based on a weight of the waste liquid container, detect the state in which the containing amount has reached the threshold value.

3. The liquid discharge apparatus according to claim 1, wherein the holding section is configured to take a first posture when the containing amount is smaller than the threshold value, and to be tilted into a second posture from the first posture when the containing amount has become larger than or equal to the threshold value, and the sensor is configured to detect a displacement of the holding section as a result of the tilting of the holding section.

4. The liquid discharge apparatus according to claim 3, wherein the calculation section resets the waste liquid amount when the holding section has returned to the first posture from the second posture.

* * * * *